United States Patent [19]

Arnau Manresa

[11] Patent Number: 4,643,102

[45] Date of Patent: Feb. 17, 1987

[54] TOY VEHICLE

[75] Inventor: Luis M. Arnau Manresa, Barcelona, Spain

[73] Assignee: Exin-Iber, S.A., Barcelona, Spain

[21] Appl. No.: 666,317

[22] Filed: Oct. 30, 1984

[30] Foreign Application Priority Data

Mar. 13, 1984 [ES] Spain ..... 278170

[51] Int. Cl.[4] ..... A63H 17/26

[52] U.S. Cl. ..... 104/305; 104/60; 446/446

[58] Field of Search ..... 104/305, 255, 60, 288, 104/295; 446/4, 6, 446, 471, 455; 273/86 B; 238/10 F

[56] References Cited

U.S. PATENT DOCUMENTS

| | | | |
|---|---|---|---|
| 2,597,094 | 5/1952 | Gutmann | 446/6 |
| 3,195,472 | 7/1965 | Rannalli | 446/446 |
| 3,202,109 | 8/1965 | Stewart | 104/60 |
| 3,263,364 | 8/1966 | Lindstrom | 104/295 |
| 3,304,652 | 2/1967 | Donoforio | 104/288 |
| 3,422,770 | 1/1969 | Celesia | 104/305 |
| 3,596,397 | 3/1971 | Colletti | 446/446 |
| 4,200,287 | 4/1980 | Ryan et al. | 104/60 |
| 4,479,650 | 10/1984 | Neuhierl | 104/305 |

*Primary Examiner*—Randolph A. Reese
*Assistant Examiner*—Donald T. Hajec
*Attorney, Agent, or Firm*—Cushman, Darby & Cushman

[57] ABSTRACT

A toy vehicle is provided with a main frame which is tiltably mounted on a plate which, at an end thereof opposite the pivot mount is provided with a pair of mutually orthogonally located bushings one of which accommodates a vertical pivot shaft to which is connected a guide plate or fin; the vehicle is adapted to ride on tracks whereby the fin will serve to guide the vehicle and where the bushings will permit rotation of the frame about a vertical axis as well as turning of the vehicle to follow the contour of a track.

5 Claims, 4 Drawing Figures

TOY VEHICLE

BACKGROUND AND SUMMARY OF THE INVENTION

The present invention relates to an improved toy vehicle.

More specifically, this invention is related to a toy vehicle such as a car of the type comprising a small electrical motor and which is run on tracks made up of severally mutually engaged plates including guide members which are flanked by electrically conductive rails. The vehicle is provided with contacts to draw current from the rail or rails to supply current to the motor of the vehicle.

In the past, vehicles have been designed to run on tracks with high speed and stability. However, upon impact with an obstacle, the front wheels of the vehicle are often lifted from the track causing disengagement of the guide elements whereupon contact with the electrical rail is lost so that the vehicle stops running.

The vehicle of the present invention has the purpose of avoiding this disadvantage and further has the object of running properly in the portions of the racetrack which are made difficult by a deliberate arrangement or positioning of several obstacles on the track whereby the traditional play operation of the toy vehicle race may be converted into a collision or cross-country car race with the excitement and enjoyment this brings to the vehicle's user.

To obtain the above objects, the vehicle of the present invention uses a special wheel holder frame wherein a member is provided which runs in the track's guide and is in the form of a fin or plate which is located at the forward end of an arm member which is resiliently connected on a pivot shaft with the wheel holder frame. The guide fin is connected to the arm member through an intermediate component which is associated with two mutually orthogonal bushings. One of the bushings is vertically located and the guide fin is provided with a shaft which is inserted into the vertical bushing whereby the guide fin is pivotable about the vertical axis defined by the shaft. The other bushing is horizontally located and attached adjacent the forward end of the arm member. A shaft extends from the intermediate member through this latter bushing to permit tilting of the vehicle and wheel holder frame about a horizontal axis without affecting the orientation of the guide member with respect to the guide track. The vehicle frame may be provided with abutment members to limit the degree of pivoting about the respective axes.

The present invention will be better understood by reference to the annexed drawings which show a practical and non-limiting embodiment of the present invention.

DETAILED DESCRIPTION OF THE INVENTION

Figure 1:
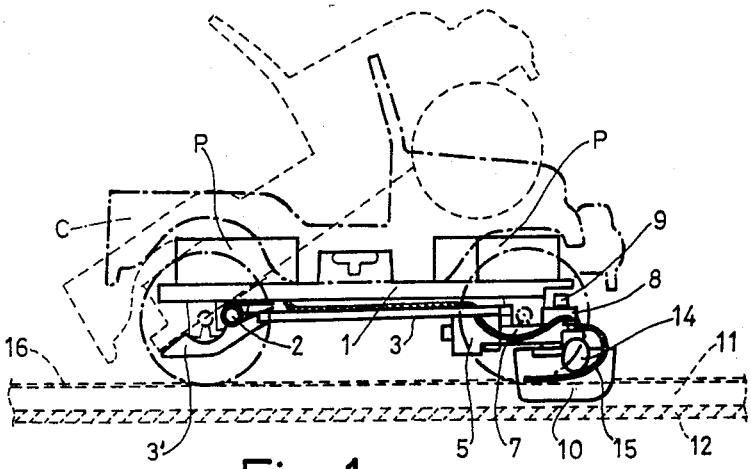
FIG. 1 is a side view in elevation of the assembly of a vehicle and illustrating in dotted lines the two possible positions of the toy vehicle chassis with respect to the frame.
Figure 2:
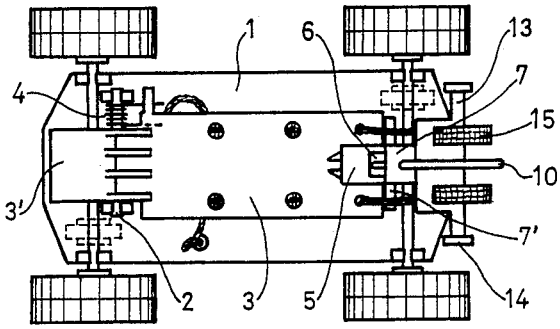
FIG. 2 is a bottom plan view of the vehicle of FIG. 1.
Figure 3:
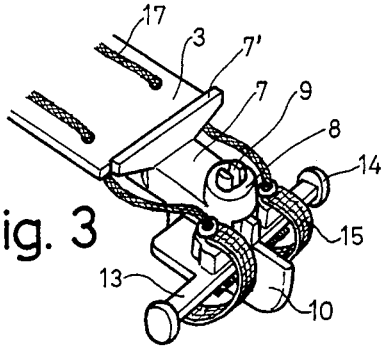
FIGS. 3 and 4 show respective perspective views of the front end elements of the vehicle frame.
Figure 4:
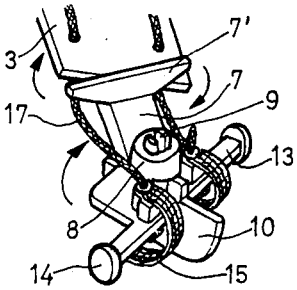

The vehicle of the present invention comprises a frame 1 which, adjacent its rear end is provided with a pivot shaft 2 on which is pivotably mounted a longitudinally extending arm member or plate 3. As shown in FIG. 2, the shaft 2 is provided with a helical spring 4 the opposite ends of which are extended to engage the underside of the frame 1 and the top of plate 3, respectively, so as to continuously urge the frame 1 and plate 3 apart. In use, the frame 1 may be provided with weights P having a mass sufficient to just overcome the force of the spring 4.

Adjacent the front end of the plate 3, horizontal bushing 5 is centrally positioned and secured to the underside of the plate 3. Forward of the front end of the plate 3 an intermediate member 7 is provided and which includes a shaft 6 which extends horizontally through the bushing 5. The shaft 6 may be secured to or formed integrally with the intermediate member 7. The shaft 6 may be freely rotatable in the bushing 5. On the underside of the intermediate member 7, there is located a guide plate or fin 10 having an upper edge from which extends a pivot shaft 9. Shaft 9 extends through a vertically disposed bushing 8 which is formed integrally with or connected to the intermediate member 7 whereby the guide fin 10 is freely rotatable about a vertical axis defined by the shaft 9.

In the normal running of the vehicle on the track, the frame 1, loaded with the weights P overcomes the force of the springs 4 so that, at the front of the vehicle, the chassis rests against an area of the plate 3, specifically, against the top cross-member 7' located on the intermediate member 7 thus achieving an aligned and stabilized position of the vehicle.

When the vehicle encounters an obstacle when running, the wheels of the vehicle which are driven by an electric motor and which run on the top of the tracks 16 tends to rise over the obstacle causing lifting of the frame 1 and the chassis C. The degree of lifting is limited by the abutment arm 3' which is attached to the underside of plate 3 at the rear thereof.

The guide fin 10 will remain in its horizontal position between the guide tracks 11. Further, the intermediate member is provided with small laterally projecting arms 13 having heads 14 which remain above the track 12 and assist in stabilizing the vehicle's running.

In the illustrated embodiment, the reference numeral 15 designates the conducting flexible strips which may contact with the electrically conductive rail 16 with the cable 17 feeding the current from the strips to the vehicle's motor.

It should be understood that the body and frame can be of any desired shape and may include a number of accessories. Further, the heads 14 on the arms 13 could be made with bearing surfaces or spheroidal bodies to facilitate stabilizing of the vehicle on the track.

Having described the invention, it will be apparent to those skilled in the art that various modifications may be made thereto without departing from the spirit and scope of this invention as defined in the appended claims.

What is claimed is:

1. A toy vehicle, of the type having a chassis including wheels and means for driving at least some of the wheels, comprising:

a first member connectable to the chassis and having an underside, a second member having one end pivotally connected to said underside, means constantly urging said first and second members apart, said second member having a second end opposite said one end and bushing means disposed adjacent said second end, said vehicle further including an intermediate member having a generally horizontally extending shaft rotatably received in said bushing means of said second member so as to permit rotating movement of the intermediate member about an axis extending longitudinally of the vehicle, said intermediate member having bushing means for rotatably receiving a shaft at a right angle to said shaft received in said bushing means of said second member, a guide means for cooperation with a guide track, said guide means including said shaft received in said bushing means of said intermediate member.

2. The vehicle of claim 1 wherein said guide means includes a pair of side arms, and further includes means for stabilizing said vehicle on said track, said means comprising heads on each of said side arms.

3. The vehicle of claim 1 wherein a vehicle chassis is mounted on said first member, said chassis including track engaging wheels.

4. The vehicle of claim 1 wherein said urging means is a spring.

5. The vehicle of claim 4 wherein said first member is provided with weight means sufficient to overcome the force of said urging.

* * * * *